US007738666B2

(12) United States Patent
Marquis

(10) Patent No.: US 7,738,666 B2
(45) Date of Patent: Jun. 15, 2010

(54) METHOD FOR ADJUSTING A SYSTEM FOR PROVIDING HEARING ASSISTANCE TO A USER

(75) Inventor: Francois Marquis, Oron-le-Chatel (CH)

(73) Assignee: Phonak AG, Staefa (CH)

( * ) Notice: Subject to any disclaimer, the term of this patent is extended or adjusted under 35 U.S.C. 154(b) by 1049 days.

(21) Appl. No.: 11/421,533

(22) Filed: Jun. 1, 2006

(65) Prior Publication Data

US 2007/0282393 A1 Dec. 6, 2007

(51) Int. Cl.
*H04R 25/00* (2006.01)

(52) U.S. Cl. ..... 381/315; 381/60; 381/331

(58) Field of Classification Search ..... 381/23.1, 381/60, 312, 315, 331, 384; 379/52, 55.1, 379/430

See application file for complete search history.

(56) References Cited

U.S. PATENT DOCUMENTS

| | | | | |
|---|---|---|---|---|
| 5,343,532 | A * | 8/1994 | Shugart, III | 381/315 |
| 5,420,930 | A * | 5/1995 | Shugart, III | 381/315 |
| 5,734,976 | A | 3/1998 | Bartschi et al. | |
| 6,639,990 | B1 * | 10/2003 | Astrin et al. | 381/312 |
| 6,850,775 | B1 * | 2/2005 | Berg | 381/315 |
| 6,895,098 | B2 | 5/2005 | Allegro et al. | |
| 6,910,013 | B2 | 6/2005 | Allegro et al. | |
| 7,072,480 | B2 | 7/2006 | Rass | |
| 7,397,926 | B1 * | 7/2008 | Frerking | 381/331 |
| 2005/0281424 | A1 | 12/2005 | Rass | |

FOREIGN PATENT DOCUMENTS

| | | | |
|---|---|---|---|
| CA | 2 439 427 | A1 | 4/2002 |
| CA | 2 422 449 | A1 | 3/2003 |
| DE | 103 45 173 | B3 | 1/2005 |
| EP | 1 443 803 | A2 | 8/2004 |
| EP | 1 619 926 | A1 | 1/2006 |
| EP | 1 638 367 | A2 | 3/2006 |
| WO | WO 97/211325 | A1 | 6/1997 |
| WO | WO 02/23948 | A1 | 3/2002 |
| WO | WO 02/30153 | A1 | 4/2002 |

* cited by examiner

*Primary Examiner*—Suhan Ni
(74) *Attorney, Agent, or Firm*—David S. Safran; Roberts Mlotkowski Safran & Cole, P.C.

(57) ABSTRACT

There is provided a method for adjusting a system for providing hearing assistance to a user (101), the system comprising a microphone arrangement (26) for capturing audio signals, a transmission unit (102) for transmitting the audio signals via a wireless link (107) to a receiver unit (103) worn by the user, a gain control unit (126) located in the receiver unit for setting the gain applied to the audio signals, and means (38) worn at or in a user's ear (39) for stimulating the hearing of the user according to the audio signals from the receiver unit (103), said method comprising: generating test audio signals, transmitting said test audio signals at a predefined level from the transmission unit via the wireless link to the receiver unit and stimulating the user's hearing with said test audio signals via said stimulating means; simultaneously transmitting gain control commands from the transmission unit to the gain control unit in order to selectively change the gain set by the gain control unit; repeating these steps until an optimum value of the gain set by the gain control unit has been determined; and transmitting a store command from the transmission unit to the receiver unit in order to store that determined optimum value of the gain.

28 Claims, 5 Drawing Sheets

METHOD FOR ADJUSTING A SYSTEM FOR PROVIDING HEARING ASSISTANCE TO A USER

BACKGROUND OF THE INVENTION

1. Field of the Invention

The present invention relates to a method for adjusting a system for providing hearing assistance to a user; it also relates to a corresponding system. In particular, the invention relates to a system comprising a microphone arrangement for capturing audio signals, a transmission unit for transmitting the audio signals via a wireless audio link from the transmission unit to a receiver unit, and means worn at or in the user's ear for stimulating the hearing of the user according to the audio signals received by the receiver unit.

2. Description of Related Art

Usually in such systems the wireless audio link is an FM radio link. According to a typical application of such wireless audio systems the receiver unit is connected to or integrated into a hearing instrument, such as a hearing aid, with the transmitted audio signals being mixed with audio signals captured by the microphone of the hearing instrument prior to being reproduced by the output transducer of the hearing instrument. The benefit of such systems is that the microphone of the hearing instrument can be supplemented or replaced by a remote microphone which produces audio signals which are transmitted wirelessly to the FM receiver and thus to the hearing instrument. In particular, FM systems have been standard equipment for children with hearing loss in educational settings for many years. Their merit lies in the fact that a microphone placed a few inches from the mouth of a person speaking receives speech at a much higher level than one placed several feet away. This increase in speech level corresponds to an increase in signal-to-noise ratio (SNR) due to the direct wireless connection to the listener's amplification system. The resulting improvements of signal level and SNR in the listener's ear are recognized as the primary benefits of FM radio systems, as hearing-impaired individuals are at a significant disadvantage when processing signals with a poor acoustical SNR.

Most FM systems in use today provide two or three different operating modes. The choices are to get the sound from: (1) the hearing instrument microphone alone, (2) the FM microphone alone, or (3) a combination of FM and hearing instrument microphones together.

Usually, most of the time the FM system is used in mode (3), i.e. the FM plus hearing instrument combination (often labeled "FM+M" or "FM+ENV" mode). This operating mode allows the listener to perceive the speaker's voice from the remote microphone with a good SNR while the integrated hearing instrument microphone allows to listener to also hear environmental sounds. This allows the user/listener to hear and monitor his own voice, as well as voices of other people or environmental noise, as long as the loudness balance between the FM signal and the signal coming from the hearing instrument microphone is properly adjusted. The so-called "FM advantage" measures the relative loudness of signals when both the FM signal and the hearing instrument microphone are active at the same time. As defined by the ASHA (American Speech-Language-Hearing Association 2002), FM advantage compares the levels of the FM signal and the local microphone signal when the speaker and the user of an FM system are spaced by a distance of two meters. In this example, the voice of the speaker will travel 30 cm to the input of the FM microphone at a level of approximately 80 dB-SPL, whereas only about 65 dB-SPL will remain of this original signal after traveling the 2 m distance to the microphone in the hearing instrument. The ASHA guidelines recommend that the FM signal should have a level 10 dB higher than the level of the hearing instrument's microphone signal at the output of the user's hearing instrument.

When following the ASHA guidelines (or any similar recommendation), the relative gain, i.e. the ratio of the gain applied to the audio signals produced by the FM microphone and the gain applied to the audio signals produced by the hearing instrument microphone, has to be set to a fixed value in order to achieve e.g. the recommended FM advantage of 10 dB under the above-mentioned specific conditions. Accordingly,—depending on the type of hearing instrument used—the audio output of the FM receiver has been adjusted in such a way that the desired FM advantage is either fixed or programmable by a professional, so that during use of the system the FM advantage—and hence the gain ratio—is constant in the FM+M mode of the FM receiver.

CA 2422449 A1 relates to an example of such an FM receiver which not only receives audio signals from a remote microphone transmitter but in addition may communicate with remote devices such as a remote control or a programming unit via wireless link for data transmission.

EP 1 638 367 A2 relates to another example of an FM receiver for receiving audio signals from a remote microphone transmitter, wherein the FM receiver upon receipt of a polling signal from the remote microphone transmitter is capable of transmitting status information regarding the FM receiver to the remote microphone transmitter.

WO 97/21325 A1 relates to a hearing system comprising a remote unit with a microphone and an FM transmitter and an FM receiver connected to a hearing aid equipped with a microphone. The hearing aid can be operated in three modes, i.e. "hearing aid only", "FM only" or "FM+M". In the FM+M mode the maximum loudness of the hearing aid microphone audio signal is reduced by a fixed value between 1 and 10 dB below the maximum loudness of the FM microphone audio signal, for example by 4 dB. Both the FM microphone and the hearing aid microphone may be provided with an automatic gain control (AGC) unit.

WO 02/30153 A1 relates to a hearing system comprising an FM receiver connected to a digital hearing aid, with the FM receiver comprising a digital output interface in order to increase the flexibility in signal treatment compared to the usual audio input parallel to the hearing aid microphone, whereby the signal level can easily be individually adjusted to fit the microphone input and, if needed, different frequency characteristics can be applied. However, is not mentioned how such input adjustment can be done.

Contemporary digital hearing aids are capable of permanently performing a classification of the present auditory scene captured by the hearing aid microphones in order to select the hearing aid operation mode which is most appropriate for the determined present auditory scene. Examples for such hearing aids with auditory scene analyses can be found in US2002/0037087, US2002/0090098, CA 2439427 A1 and US2002/0150264.

Usually FM or inductive receivers are equipped with a squelch function by which the audio signal in the receiver is muted if the level of the demodulated audio signal is too low in order to avoid user's perception of excessive noise due a too low sound pressure level at the remote microphone or due to a large distance between the transmission unit and the receiver unit exceeding the reach of the FM link, see for example U.S. Pat. No. 5,734,976 and EP 1 619 926 A1.

As already mentioned above, usually the FM advantage is set to a value of about 10 dB, which value is a compromise taking into account a medium surrounding noise level and a good intelligibility of both the FM audio signal and the voice of the neighbours. Further, this value is based on a medium sensitivity of the hearing aid audio input and on a specific microphone impedance of the hearing aid microphone. Variations of the audio input sensitivity of different hearing aids due to microphone impedance and/or sensitivity variations will have a direct impact on the desired FM advantage of 10 dB, i.e. they will cause a deviation from this desired value, resulting in a decreasing comprehension and listening comfort. Measurements have shown audio input sensitivity variations of up to ±6 dB between the main hearing aid models present in the market. This implies that in practice the FM advantage will vary between 4 dB and 16 dB, depending on the hearing aid model connected to the FM receiver, instead of the desired value of 10 dB. In addition to that, tolerances of the FM transmitter and FM receiver gain are also added to the total FM advantage variation. Further, the desired FM advantage of 10 dB is a recommendation only and may not be optimum in any case or situation. In specific cases, the individual user's perception may require another value of the FM advantage than 10 dB.

It is an object of the invention to provide for a method for adjusting a system for providing hearing assistance to a user, wherein a remote microphone arrangement coupled by a wireless audio link to a receiver unit worn by the user is used and wherein perception of the transmitted audio signals should be optimized for the specific user, independently of the hearing instrument model and the FM system parameter variations and tolerances. It is a further object to provide for a corresponding system.

SUMMARY OF THE INVENTION

According to the invention, this object is achieved by a method as defined in claim 1 and by a system as defined in claim 29, respectively.

The invention is beneficial in that, by transmitting test audio signals to the receiver unit, simultaneously changing the gain by transmitting corresponding gain control commands to the receiver unit until an optimum value of the gain has been determined by the user, and storing that determined optimum gain value, undesired individual deviations of the perception of the audio signals from the remote microphone arrangement from the desired condition due to individual parameter variations and individual tolerances of the system can be avoided, so that for each practical individual system the desired optimum gain applied to the audio signals of the remote microphone arrangement can be determined and stored in order to use this optimum value during normal operation of the system.

According to a preferred embodiment, the system comprises a hearing instrument which is worn at the user's ear and which is connected to the receiver unit or comprises the receiver unit, with the hearing instrument comprising the stimulating means, a second microphone arrangement for capturing second audio signals, and means for mixing the audio signals from the gain control unit and the second audio signals prior to stimulating the user's hearing with the mixed audio signals via said stimulating means. For such a system the individual FM advantage, i.e. the ratio of the gain applied to the audio signals from the remote microphone arrangement applied to the audio signals from the hearing instrument microphone arrangement, can by be individually optimized regardless of individual parameter variations and individual tolerances.

Usually the audio signals from the receiver unit and the hearing instrument microphone will be mixed in the hearing instrument in such a manner that they are processed and power-amplified together so that gain applied to these audio signals in the hearing instrument is the same for both kinds of audio signals; consequently, after mixing the gain ratio will not be changed by the usual dynamic audio signal processing of the hearing instrument. Thus, by controlling the gain applied to the audio signals from the remote microphone arrangement by the gain control unit of the receiver unit, also the gain ratio, i.e. the ratio of the gain applied to the audio signals from the remote microphone arrangement and the gain applied to the audio signals from the hearing instrument microphone, can be controlled.

The parameter variations and tolerances which can be compensated by the adjustment method of the present invention include the following: microphone sensitivity of the radio transmitter, modulation strength of the radio transmitter, audio output level of the radio receiver, output impedance of the radio receiver, audio input sensitivity of the hearing aid, audio input impedance of the hearing aid, and specific sensitivity of the user.

According to one embodiment, the test audio signals are generated by retrieving audio signals from a memory. According to another embodiment, the test audio signals may be generated by an audio signal synthesizer. According to a further alternative embodiment, the test audio signals may be generated by generating a test sound which is captured as the test audio signals by the remote microphone arrangement; usually the test sound will be the voice of a person using the transmitting unit, such as a teacher. In this case, the test sound may be captured also by the second microphone arrangement, so that for optimizing the gain, and also the gain ratio, also the audio signals captured by the second microphone arrangement may be taken into account. Typically the test audio signal transmitted to the receiver unit will be transmitted at a maximum level of the audio signals of the remote microphone arrangement, which is typical when the person using the transmitting unit is speaking.

A data link for transmitting the commands to the receiver unit and the audio signal link may be realized by a common transmission channel, with the bandwidth being split.

According to one embodiment, the system may be operated in such a manner that the gain is kept constant at a value corresponding to the determined optimum value. According to an alternative embodiment, the system may be operated in such a manner that the gain is dynamically changed according to the result of a permanently repeated auditory scene analysis based on at least one of the audio signals provided by the remote microphone arrangement and the audio signals provided by the hearing instrument microphone arrangement. In this case the determined optimum value of the gain is used to calibrate the gain control unit, i.e. the gain control algorithm is calibrated by the determined optimum gain value.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
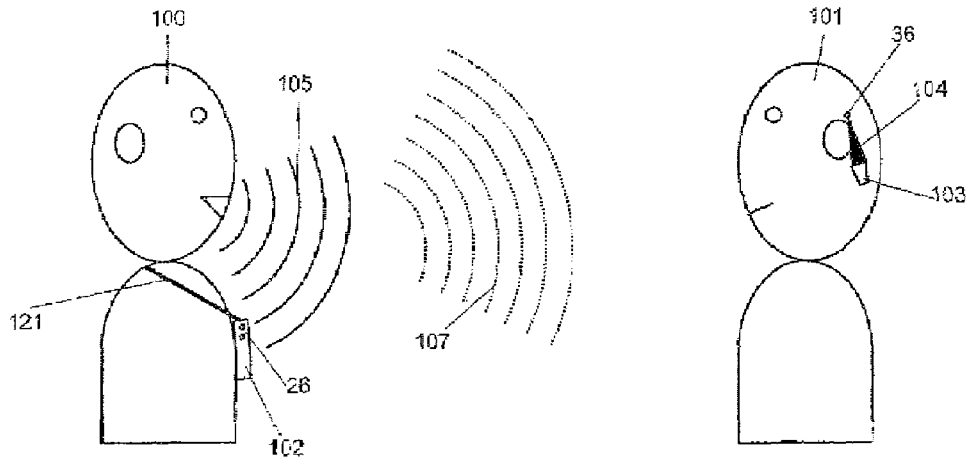
FIG. 1 is a schematic view of the use of an embodiment of a hearing assistance system according to the invention.

FIG. 1 shows schematically the use of a system for hearing assistance comprising an FM radio transmission unit 102 comprising a directional microphone arrangement 26 consisting of two omnidirectional microphones M1 and M2 which are spaced apart by a distance d, an FM radio receiver unit 103, and hearing instrument 104 comprising a microphone arrangement 36. The audio output of the receiver unit 103 is connected to an audio input of the hearing instrument 104 via an audio shoe (not shown). The transmission unit 102 is worn by a speaker 100 around his neck by a neck-loop 121 acting as an FM radio antenna, with the microphone arrangement 26 capturing the sound waves 105 carrying the speaker's voice. Audio signals and control data are sent from the transmission unit 102 via radio link 107 to the receiver unit 103 worn by a user/listener 101. In addition to the voice 105 of the speaker 100 background/surrounding noise 106 may be present which will be both captured by the microphone arrangement 26 of the transmission unit 102 and microphone arrangement 36 of the hearing instrument 104. Typically the speaker 100 will be a teacher and the user 101 will be a hearing-impaired person in a classroom, with background noise 106 being generated by other pupils.

Figure 8:
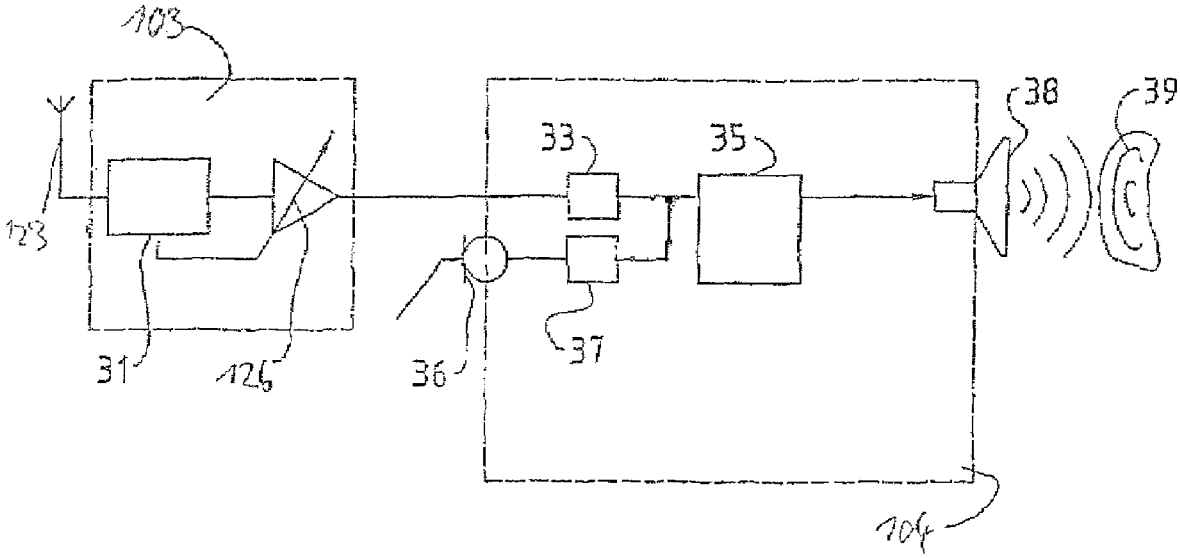
FIG. 8 shows schematically an example in which the receiver unit is connected to a separate audio input of a hearing aid.

FIG. 8 is a block diagram of an example in which the receiver unit 103 is connected to a high impedance audio input of the hearing instrument 104. The receiver unit 103 contains a module 31 for demodulation and signal processing for processing the FM signal received by the antenna 123 from the antenna of the transmission unit 102 (these audio signals resulting from the microphone arrangement 26 of the transmission unit 102 in the following also will be referred to as "first audio signals"). The processed first audio signals are amplified by variable gain amplifier 126. The output of the receiver unit 103 is connected to an audio input of the hearing instrument 104 which is separate from the microphone 36 of the hearing instrument 15 (such separate audio input has a high input impedance).

The first audio signals provided at the separate audio input of the hearing instrument 104 may undergo pre-amplification in a pre-amplifier 33, while the audio signals produced by the microphone 36 of the hearing instrument 104 (in the following referred to "second audio signals") may undergo pre-amplification in a pre-amplifier 37. The hearing instrument 104 further comprises a digital central unit 35 into which the first and second audio signals are supplied as a mixed audio signal for further audio signal processing and amplification prior to being supplied to the input of the output transducer 38 of the hearing instrument 104. The output transducer 38 serves to stimulate the user's hearing 39 according to the combined audio signals provided by the central unit 35.

Figure 9:
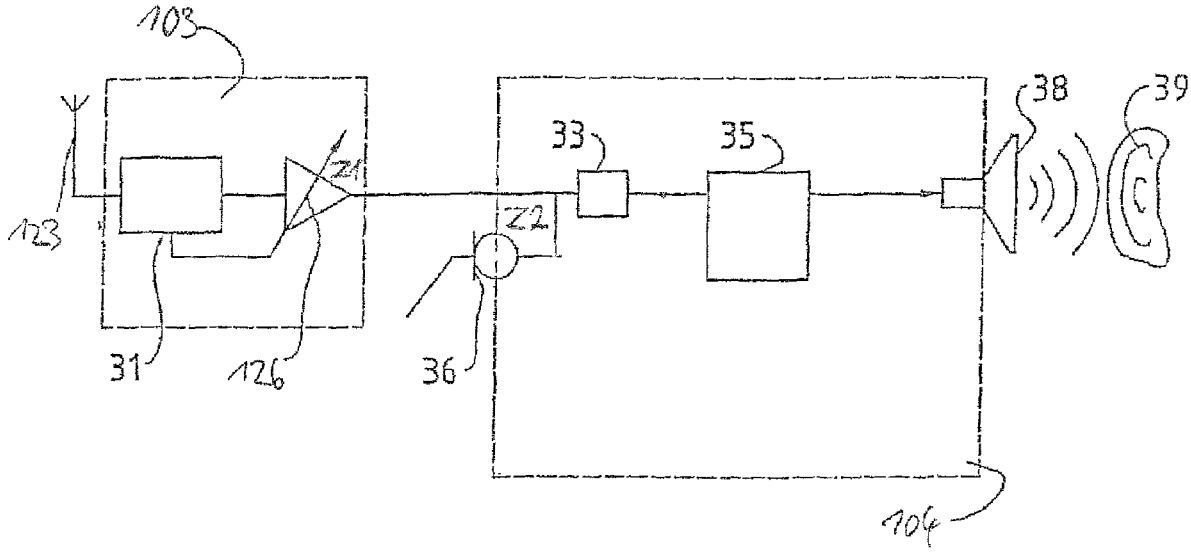
FIG. 9 shows schematically an example in which the receiver unit is connected in parallel to the microphone arrangement of a hearing aid.

FIG. 9 shows a modification of the embodiment of FIG. 8, wherein the output of the receiver unit 103 is not provided to a separate high impedance audio input of the hearing instrument 104 but rather is provided to an audio input of the hearing instrument 104 which is connected in parallel to the hearing instrument microphone 36. Also in this case, the first and second audio signals from the remote microphone arrangement 26 and the hearing instrument microphone 36, respectively, are provided as a combined/mixed audio signal to the central unit 35 of the hearing instrument 104. The gain applied to first audio signals can be adjusted by the variable gain amplifier 126 of the receiver unit 103. Further, also the gain ratio for the first and second audio signals can be controlled by the receiver unit 103 by accordingly controlling the signal at the audio output of the receiver unit 103 and the output impedance Z1 of the audio output of the receiver unit 103.

Figure 2:
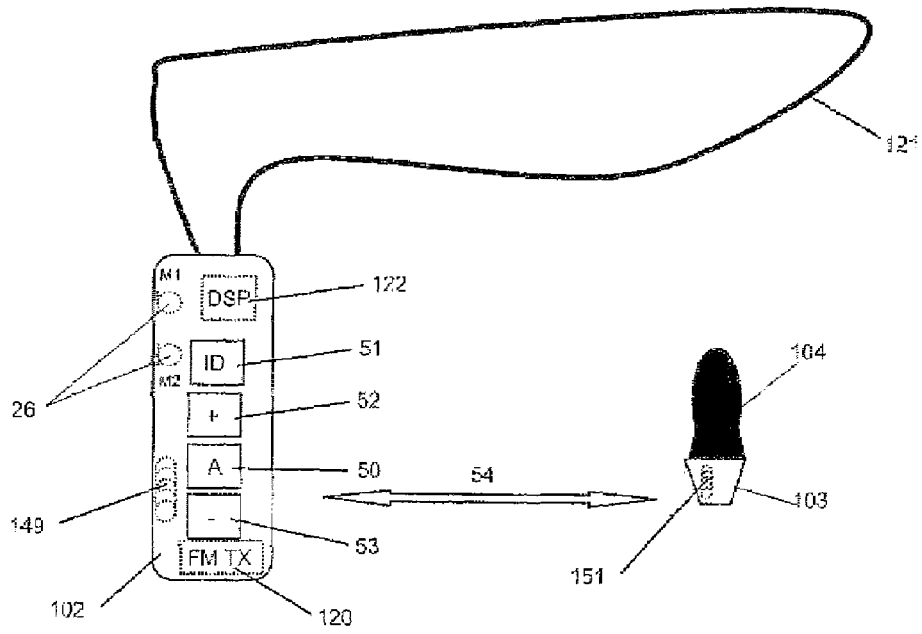
FIG. 2 is a schematic view of the transmission unit of the system of FIG. 1.

FIG. 2 is a schematic view of the transmission unit 102 which, in addition to the microphone arrangement 26, comprises a digital signal processor 122, an FM transmitter 120, an antenna 149 for establishing a short distance bidirectional inductive link 54 with an antenna 151 of the receiver unit 103, a button 50 for activating an FM advantage adjustment mode of the transmission unit 102 and the receiver unit 103, a button 51 to read identification information stored in the receiver unit 103 via the inductive link 54, a button 52 for causing a "volume up" command being transmitted to the receiver unit 103, and a button 53 for causing a "volume down" command being transmitted to the receiver unit 103.

Figure 3:
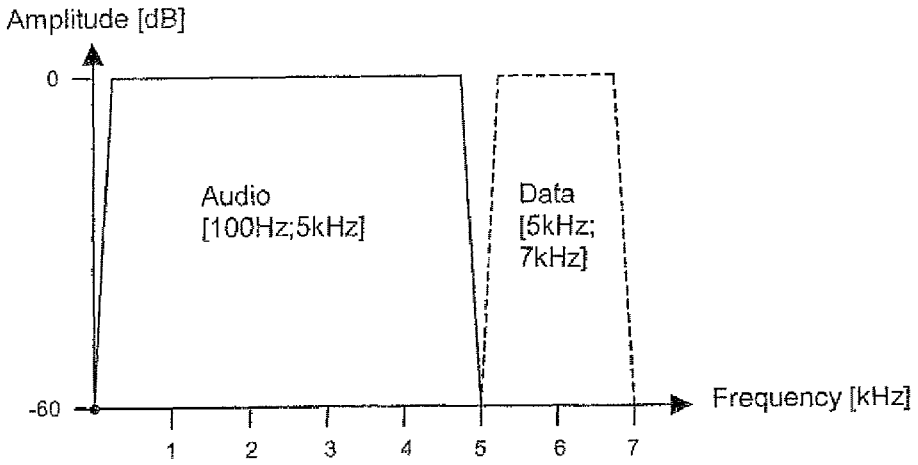
FIG. 3 is a diagram showing the signal amplitude versus frequency of the common audio signal/data transmission channel of the system of FIG. 1.

According to FIG. 3, the channel bandwidth of the FM radio transmitter, which, for example, may range from 100 Hz to 7 kHz, is split in two parts ranging, for example from 100 Hz to 5 kHz and from 5 kHz to 7 kHz, respectively. In this case, the lower part is used to transmit the audio signals (i.e. the first audio signals) resulting from the microphone arrangement 26, while the upper part is used for transmitting data from the FM transmitter 120 to the receiver unit 103. The data link established thereby can be used for transmitting control commands relating to the gain from the transmission unit 102 to the receiver 103, and it also can be used for transmitting general information or commands to the receiver unit 103.

Figure 5:
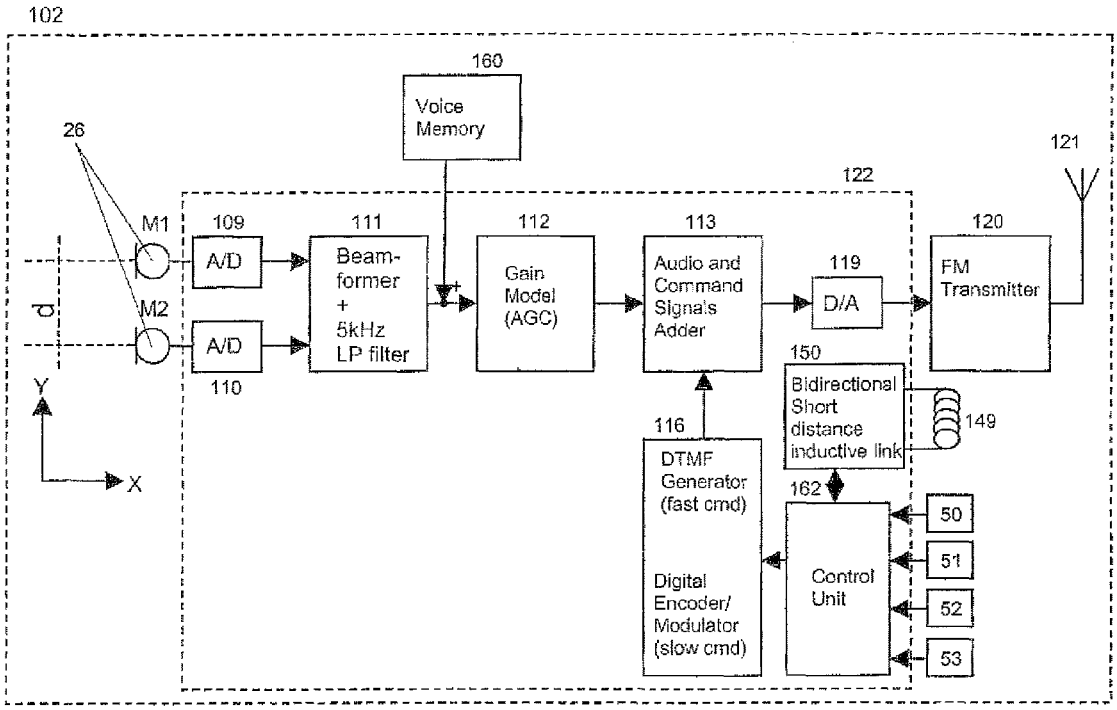
FIG. 5 is a block diagram of one embodiment of the transmission unit of the system of FIG. 1.

The internal architecture of the FM transmission unit 102 is schematically shown in FIG. 5. As already mentioned above, the spaced apart omnidirectional microphones M1 and M2 of the microphone arrangement 26 capture both the speaker's voice 105 and the surrounding noise 106 and produce corresponding audio signals which are converted into digital signals by the analog-to-digital converters 109 and 110. M1 is the front microphone and M2 is the rear microphone. The microphones M1 and M2 together associated to a beamformer algorithm form a directional microphone arrangement 26 which, according to FIG. 1, is placed at a relatively short distance to the mouth of the speaker 100 in order to insure a good SNR at the audio source and also to allow the use of easy to implement and fast algorithms for voice detection as will be explained in the following. The converted digital signals from the microphones M1 and M2 are supplied to the unit 111 which comprises a beam former implemented by a classical beam former algorithm and a 5 kHz low pass filter. The first audio signals leaving the beam former unit 111 are supplied to a gain model unit 112 which mainly consists of an automatic gain control (AGC) for avoiding an overmodulation of the transmitted audio signals. The output of a gain model unit 112 is supplied to an adder unit 113 which mixes the first audio signals, which are limited to a range of 100 Hz to 5 kHz due to the 5 kHz low pass filter in the unit 111, and DTMF (dual-tone multi-frequency) encoded data signals supplied from a control unit 162 within a range from 5 kHz and 7 kHz. The combined audio/data signals are converted to analog by a digital-to-analog converter 119 and then are supplied to the FM transmitter 120 which uses the neck-loop 121 as an FM radio antenna.

The transmission unit 102 further comprises a voice memory 160 in which test audio signals are stored which can be retrieved by request of a control unit 162 and which are then supplied to the gain model unit 112. The control unit 162 generates commands for controlling the transmission unit 102 and the receiver unit 103 according to operation of the buttons 50 to 53 by the user 100. Such control commands are transmitted via the FM transmitter 120 and the antenna 121 to the receiver unit 103. The units 109, 110, 111, 112, 113, 119 and 162 all can be realized by the digital signal processor 122 of the transmission unit 102.

Figure 4:
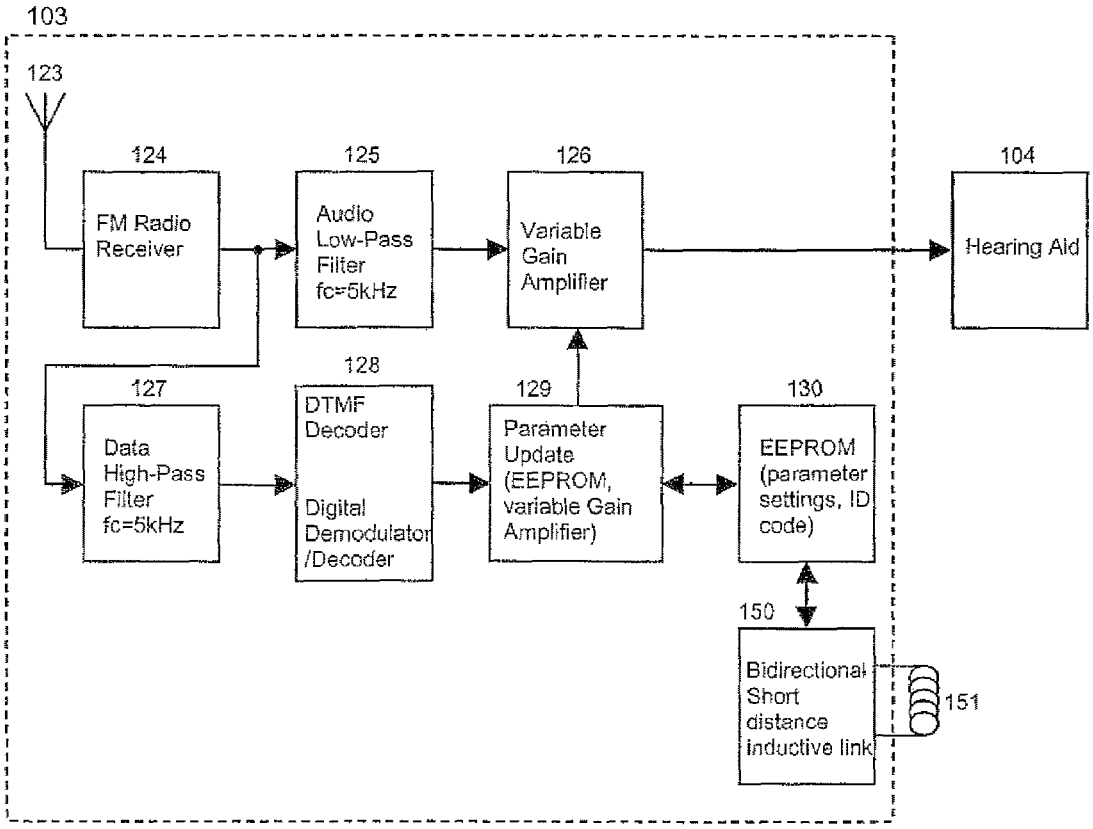
FIG. 4 is a block diagram of one embodiment of the receiver unit of the system of FIG.

The receiver unit 103 is schematically shown in FIG. 4. The audio signals produced by the microphone arrangement 26 and processed by the units 111 and 112 of transmission unit 102 and the command signals produced by the control unit 162 of the transmission unit 102 are transmitted from the transmission unit 102 over the same FM radio channel to the receiver unit 103 where the FM radio signals are received by the antenna 123 and are demodulated in an FM radio receiver 124. An audio signal low pass filter 125 operating at 5 kHz supplies the audio signals to a variable gain amplifier 126 from where the audio signals are supplied to the audio input of the hearing instrument 104. The output signal of the FM radio receiver 124 is also filtered by a high pass filter 127 operating at 5 kHz in order to extract the commands from the control unit 162 contained in the FM radio signal. A filtered signal is supplied to a unit 128 including a DTMF and digital demodulator/decoder in order to decode the command signals from the control unit 162.

The command signals decoded in the unit 128 are provided to a parameter update unit 129 in which the parameters of the commands are updated according to information stored in an EEPROM 130 of the receiver unit 103. The output of the parameter update unit 129 is used to control the audio signal amplifier 126 which is gain and output impedance controlled. Thereby the audio signal output of the receiver unit 103 can be controlled according to the commands from the control unit 162 in order to control the gain (and also the gain ratio, i.e. the ratio of the gain applied to the audio signals from the microphone arrangement 26 of the transmission unit 102 and the audio signals from the hearing instrument microphone 36) according to the commands from the control unit 162.

The inductive antenna 151 of the receiver unit 103 is connected via a unit 150 to the EEPROM 130 and is used for reading identification information stored in the EEPROM 130, which serves to identify the receiver unit 103, via the inductive link 54 by the transmission unit 102. In addition, the inductive link 54 may have additional functions such as reading other receiver parameters, programming the receiver unit 103, monitoring battery status, the receiver unit 103 and monitoring the quality of the link.

The desired gain determined by the amplifier 126 may be adjusted according to the following procedure.

First, the user 100 selects the respective receiver unit 103, which is to be adjusted by approaching the receiver unit 103 with the transmission unit 102 so close that the receiver unit 103 comes within the reach of the inductive link 54. Then the button 51 is pushed whereby the control unit 162 causes the transmission unit 102 to read the identification code via the inductive link 54 from the EEPROM 130 of the receiver unit 103. Once the identification code has been read by the transmission unit 102, this particular identification code is coded over the data link of the transmission unit 102 in order to address in the further adjustment procedure only the specified receiver unit 103. If the user 101 uses two hearing instruments 104, two receiver units 103 must be addressed by the transmission unit 102. If the user 101 is the only one within the reach distance of the transmission unit 102, the receiver identification step can be omitted.

As a next step, the user 100 will enter an adjustment mode of the transmission unit 102 by pushing the button 50.

In the FM advantage adjustment procedure then test audio signal is generated, for example, by retrieving a test signal from the voice memory 160. Alternatively, the test audio signals may be generated by the voice of the user 100 which is captured by the microphone arrangement 26. In the latter case, the voice of the user 100 also will be captured by the hearing instrument microphone 36. In any case, the test audio signal preferably will be transmitted to the receiver unit 103 at the maximum audio level of the transmission unit 102, which is typical for the case when the user 100 is speaking. The test audio signals provided by the low pass filter 125 will be amplified by the amplifier 126 according to the presently set gain in the EEPROM 130 and then will be supplied to the hearing instrument 104 for being reproduced by the speaker 38.

As a next step, perception of the test audio signals by the user 101 will be evaluated, and according to the result of this evaluation the volume-up-button 52 will be pushed if the user 101 feels that the volume of the audio test signals is too low, or the volume-down-button 53 will be pushed if the user 101 feels that the volume of the test audio signals is too high. Upon operation of the respective button 52 or 53 the control unit 162 will cause a corresponding control command to be transmitted to the receiver unit 103 where it is demodulated in the unit 128 and serves to correspondingly increase or reduce the gain applied by the amplifier 126 via the unit 129.

Such change of the gain applied by the amplifier 126 is continued until an optimum value—which corresponds then to the optimum value of the individual FM advantage—has been found. Thereupon that determined optimum gain value will be stored in the EEPROM 130 of the receiver unit upon receipt of a respective command sent by the transmitting unit 102. Such store command signal may be generated by the control unit 162 of the transmission unit 102 upon corresponding operation of the buttons at the transmission unit 102, for example by again pushing the "A"-button 50, or it may be generated automatically, if a certain time period without operation of the volume up or volume down-buttons 52, 53 has lapsed.

After having terminated the FM advantage adjustment procedure, the transmission unit 102 and the receiver unit 103 will resume the normal operation mode. This normal operation mode may be such that the determined optimum gain value stored in the EEPROM 130 will be continuously applied to the amplifier 126, i.e. the amplifier 126 will be operated at constant gain.

Figure 6:
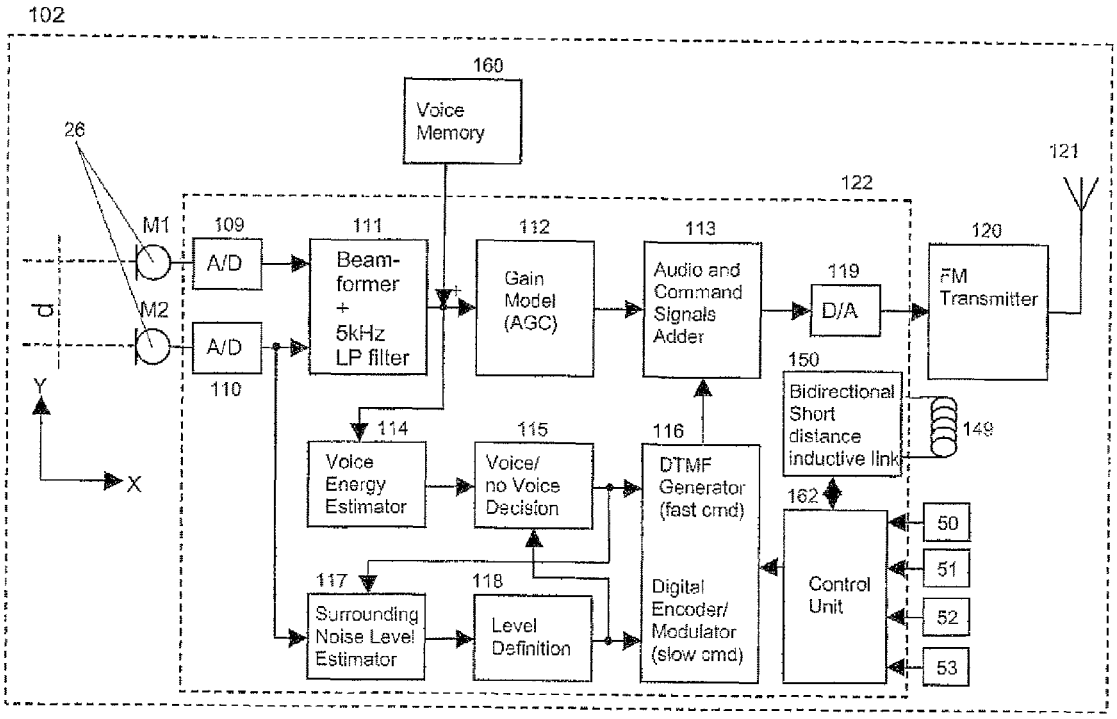
FIG. 6 is a block diagram of another embodiment of the transmission unit of the system of FIG. 1.
Figure 7:
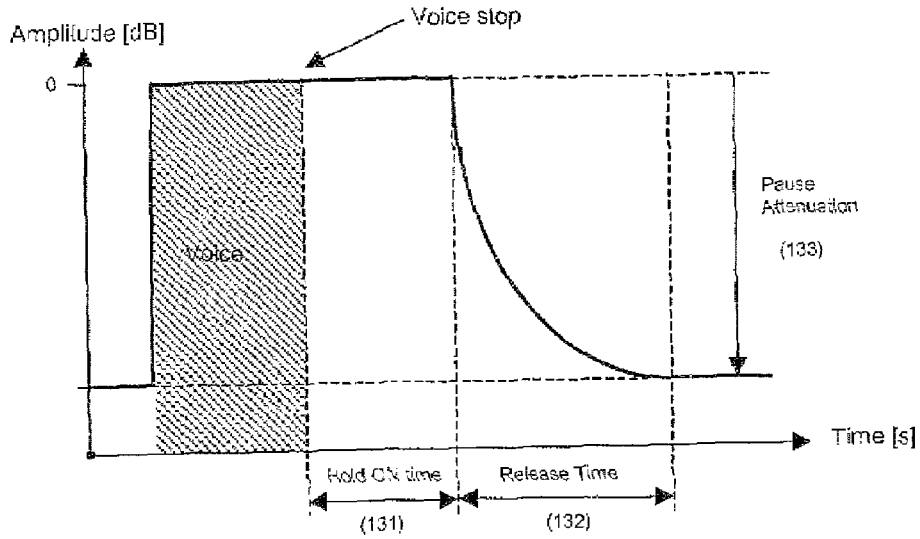
FIG. 7 is a diagram showing an example of the gain set by the gain control unit versus time.

According to an alternative embodiment which is shown in FIGS. 6 and 7, the transmission unit 102 and the receiver unit 103 may be designed such that in the normal operation mode the gain presently applied by the amplifier 126 may be changed according to the result of an auditory scene analysis permanently performed by the transmission unit 102 by analysing the audio signal captured by the microphone arrangement 26. The receiver unit 103 shown in FIG. 4 may be used also with the transmission unit 102 of FIG. 6.

To this end, the transmission unit 102 is provided with classification unit 134, the functions of which may be implemented by the digital signal processor 122. The classification unit 134 shown in FIG. 6 includes units 114, 115, 116, 117 and 118, as will be explained in detail in the following.

The unit 114 is a voice energy estimator unit which uses the output signal of the beam former unit 111 in order to compute the total energy contained in the voice spectrum with a fast attack time in the range of a few milliseconds, preferably not more than 10 milliseconds. By using such short attack time it is ensured that the system is able to react very fast when the speaker 11 begins to speak. The output of the voice energy estimator unit 114 is provided to a voice judgement unit 115 which decides, depending on the signal provided by the voice energy estimator 114, whether close voice, i.e. the speaker's voice, is present at the microphone arrangement 26 or not.

The unit 117 is a surrounding noise level estimator unit which uses the audio signal produced by the omnidirectional rear microphone M2 in order to estimate the surrounding noise level present at the microphone arrangement 26. However, it can be assumed that the surrounding noise level estimated at the microphone arrangement 26 is a good indication also for the surrounding noise level present at the microphone 36 of the hearing instrument 104, like in classrooms for example. The surrounding noise level estimator unit 117 is active only if no close voice is presently detected by the voice judgement unit 115 (in case that close voice is detected by the voice judgement unit 115, the surrounding noise level estimator unit 117 is disabled by a corresponding signal from the voice judgment unit 115). A very long time constant in the range of 10 seconds is applied by the surrounding noise level estimator unit 117. The surrounding noise level estimator unit 117 measures and analyzes the total energy contained in the whole spectrum of the audio signal of the microphone M2 (usually the surrounding noise in a classroom is caused by the voices of other pupils in the classroom). The long time constant ensures that only the time-averaged surrounding noise is measured and analyzed, but not specific short noise events. According to the level estimated by the unit 117, a hysteresis function and a level definition is then applied in the level definition unit 118, and the data provided by the level definition unit 118 is supplied to the unit 116 in which the data is encoded by a digital encoder/modulator and is transmitted continuously with a digital modulation having a spectrum a range between 5 kHz and 7 kHz. That kind of modulation allows only relatively low bit rates and is well adapted for transmitting slowly varying parameters like the surrounding noise level provided by the level definition unit 118.

The estimated surrounding noise level definition provided by the level definition unit 118 is also supplied to the voice judgement unit 115 in order to be used to adapt accordingly to it the threshold level for the close voice/no close voice decision made by the voice judgement unit 115 in order to maintain a good SNR for the voice detection.

If close voice is detected by the voice judgement unit 115, a very fast DTMF (dual-tone multi-frequency) command is generated by a DTMF generator included in the unit 116. The DTMF generator uses frequencies in the range of 5 kHz to 7 kHz. The benefit of such DTMF modulation is that the generation and the decoding of the commands are very fast, in the range of a few milliseconds. This feature is very important for being able to send a very fast "voice ON" command to the receiver unit 103 in order to catch the beginning of a sentence spoken by the speaker 11. The command signals produced in the unit 116 (i.e. DTMF tones and continuous digital modulation) are provided to the adder unit 113, as already mentioned above.

FIG. 7 illustrates an example of how the gain in the normal operation mode may be controlled according to the determined present auditory scene category.

As already explained above, the voice judgement unit 115 provides at its output for a parameter signal which may have two different values:

"Voice ON": This value is provided at the output if the voice judgement unit 115 has decided that close voice is present at the microphone arrangement 26. In this case, fast DTMF modulation occurs in the unit 116 and a control command is issued by the unit 116 and is transmitted to the amplifier 126, according to which the gain is set to a given value which, for example, may result in an FM advantage of 10 dB under the respective conditions of for example, the ASHA guidelines.

"Voice OFF": If the voice judgement unit 115 decides that no more close voice is present at the microphone arrangement 26, a "voice OFF" command is issued by the unit 116 and is transmitted to the amplifier 126. In this case, the parameter update unit 129 applies a "hold on time" constant 131 and then a "release time" constant 132 defined in the EEPROM 130 to the amplifier 126. During the "hold on time" the gain set by the amplifier 126 remains at the value applied during "voice ON". During the "release time" the gain set by the amplifier 126 is progressively reduced from the value applied during "voice ON" to a lower value corresponding to a "pause attenuation" value 133 stored in the EEPROM 130. Hence, in case of "voice OFF" the gain of the microphone arrangement 26 is reduced relative to the gain of the hearing instrument microphone 36 compared to "voice ON". This ensures an optimum SNR for the hearing instrument microphone 36, since at that time no useful audio signal is present at the microphone arrangement 26 of the transmission unit 102.

The control data/command issued by the surrounding noise level definition unit 118 is the "surrounding noise level" which has a value according to the detected surrounding noise level. As already mentioned above, the "surrounding noise level" is estimated only during "voice OFF" but the level values are sent continuously over the data link. Depending on the "surrounding noise level" the parameter update unit 129 controls the amplifier 126 such that according to definition stored in the EEPROM 130 the amplifier 126 applies an additional gain offset or an output impedance change to the audio output of the receiver unit 103.

The application of an additional gain offset is preferred in case that there is the relatively low surrounding noise level (i.e. quiet environment), with the gain of the hearing instrument microphone 36 being kept constant. The change of the output impedance is preferred in case that there is a relatively high surrounding noise level (noisy environment), with the signals from the hearing instrument microphone 36 being attenuated by a corresponding output impedance change. In both cases, a constant SNR for the signal of the microphone arrangement 26 compared to the signal of the hearing instrument microphone 36 is ensured.

A preferred application of the systems according to the invention is teaching of pupils with hearing loss in a classroom. In this case the speaker 100 is the teacher, while a user 101 is one of several pupils, with the hearing instrument 104 being a hearing aid.

The FM advantage adjustment procedure in the adjustment mode may be similar to that described above with regard to the system of FIGS. 4 and 5. In the case of the embodiment of FIGS. 6 and 7 the optimum gain value determined and stored in the adjustment mode will be used to the calibrate the gain variation based on the auditory scene analysis in the normal operation mode. In present case, for example, the value of the gain applied in the "Voice ON" regime will correspond to the optimum gain value determined and stored in the adjustment mode.

While in the embodiments described so far the receiver unit is separate from the hearing instrument, in some embodiments it may be integrated with the hearing instrument.

The microphone arrangement producing the second audio signals may be connected to or integrated within the hearing instrument. The second audio signals may undergo an automatic gain control prior to being mixed with the first audio signals. The microphone arrangement producing the second audio signals may be designed as a directional microphone comprising two spaced apart microphones.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as encompassed by the scope of the appended claims.

What is claimed is:

1. A method for adjusting a system for providing hearing assistance to a user, said system comprising a microphone arrangement for capturing audio signals, a transmission unit for transmitting said audio signals via a wireless link to a receiver unit worn by said user, a gain control unit located in said receiver unit for setting a gain applied to said audio signals, and means worn at or in a user's ear for stimulating a hearing of said user according to said audio signals from said gain control unit, said method comprising:

(a) generating test audio signals, transmitting said test audio signals at a pre-defined level from said transmission unit via said wireless link to said receiver unit and stimulating said user's hearing with said test audio signals via said stimulating means;

(b) simultaneously transmitting gain control commands from said transmission unit to said gain control unit in order to selectively change said gain set by said gain control unit;

(c) repeating steps (a) and (b) until an optimum value of said gain set by said gain control unit has been determined; and (d) transmitting a store command from said transmission unit to said receiver unit in order to store that determined optimum value of said gain.

2. The method of claim 1, wherein said system comprises a hearing instrument which is worn at or in said user's ear and which is connected to said receiver unit, said hearing instrument comprising said stimulating means, a second microphone arrangement for capturing second audio signals, and means for mixing said audio signals from said gain control unit and said second audio signals prior to stimulating said user's hearing with the mixed audio signals via said stimulating means.

3. The method of claim 2, wherein in step (a) said test audio signals are generated by retrieving audio signals from an audio signal memory.

4. The method of claim 3, wherein said audio signal memory is integrated in said transmission unit.

5. The method of claim 2, wherein in step (a) said test audio signals generated by an audio signal synthesizer.

6. The method of claim 5, wherein said audio signal synthesizer is integrated within said transmission unit.

7. The method of claim 2, wherein in step (a) said test audio signals are generated by generating a test sound and capturing said test sound as said test audio signals by said microphone arrangement.

8. The method of claim 7, wherein said test sound is a voice of a person using the transmission unit.

9. The method of claim 8, further comprising: capturing said test sound as said second audio signals by said second microphone arrangement, mixing said audio signals from said gain control unit and said second audio signals according to a presently set gain and stimulating said user's hearing with the mixed audio signals via said stimulating means of said hearing instrument.

10. The method of claim 2, wherein in step (d) said determined optimum value of said gain is stored in a memory which is integrated within said hearing instrument.

11. The method of claim 2, wherein said gain control unit comprises an amplifier which is at least one of gain controlled and output impedance controlled and which is located in said receiver unit.

12. The method of claim 2, wherein an output of said receiver unit is connected in parallel with said second microphone arrangement.

13. The method of claim 2, wherein said audio signals from said receiver unit are supplied to said hearing instrument via an audio input separate from said second microphone arrangement.

14. The method of claim 2, wherein said hearing instrument is a hearing aid having an electroacoustic output transducer as said stimulating means.

15. The method of claim 1, wherein said system comprises a hearing instrument which is worn at said user's ear and comprises said receiver unit, said hearing instrument comprising said stimulating means, a second microphone arrangement for capturing second audio signals, and means for mixing said audio signals from said gain control unit and said second audio signals prior to stimulating said user's hearing with the mixed audio signals via said stimulating means.

16. The method of claim 1, wherein in step (d) said determined optimum value of said gain is stored in a memory which is integrated within said receiver unit.

17. The method of claim 1, wherein prior to step (a) said receiver unit is identified.

18. The method of claim 17, wherein said receiver unit is identified by reading an identification information stored in said receiver unit by said transmission unit via an inductive link.

19. The method of claim 18, wherein said receiver unit is specifically addressed by said transmission unit by transmitting a signal coded according to said identification information read by said transmission unit.

20. The method of claim 1, wherein in step (a) said test signal is transmitted at a maximum level of said audio signals of said transmission unit.

21. The method of claim 1, wherein a data link for transmitting said gain control commands and said store command and said audio signal link are realized by a common transmission channel.

22. The method of claim 21, wherein a lower portion of a bandwidth of said transmission channel is used by said audio signal link and an upper portion of said bandwidth of said transmission channel is used by said data link.

23. The method of claim 1, wherein said audio signal link is a Frequency Modulated radio link.

24. The method of claim 1, wherein said audio signals in said transmission unit undergo an automatic gain control treatment in a gain model unit prior to being transmitted to said receiver unit.

25. A method for operating a system for providing hearing assistance to a user having been adjusted according to the method of claim 1, wherein said gain control unit sets said gain to a constant value, with said constant value corresponding to said stored optimum value of said gain.

26. A method for operating a system for providing hearing assistance to a user having been adjusted according to the method of claim 1, comprising (a) capturing audio signals by said microphone arrangement and transmitting said audio signals by said transmission unit via said wireless audio signal link to said receiver unit;

(b) analyzing said audio signals prior to being transmitted by a classification unit in order to determine a present auditory scene category from a plurality of auditory scene categories;

(c) setting by said gain control unit a gain applied to said audio signals according to said present auditory scene category determined in step (b);

(d) stimulating said user's hearing by said stimulating means according to said audio signals from said gain control unit;

wherein said stored optimum value of said gain is used to calibrate said gain control unit.

27. The method of claim 26, wherein said gain applied for at least one of said auditory scenes is said stored optimum value of said gain.

28. The method of claim 27, wherein said gain control unit sets said gain to a constant value as long as said classification unit determines a level of said audio signals above a given threshold, wherein said constant value corresponds to said stored optimum value.

* * * * *